US005919034A

United States Patent [19]

Kawano et al.

[11] Patent Number: 5,919,034

[45] Date of Patent: Jul. 6, 1999

[54] SCROLL COMPRESSOR AND METHOD FOR MANUFACTURING AN OLDHAM RING THEREFOR

[75] Inventors: Hiroyuki Kawano; Hideo Hirano; Hideto Oka, all of Shiga, Japan

[73] Assignee: Matsushita Electric Industrial Co.,Ltd., Osaka, Japan

[21] Appl. No.: 08/910,336

[22] Filed: Aug. 13, 1997

Related U.S. Application Data

[62] Division of application No. 08/730,397, Oct. 15, 1996, Pat. No. 5,842,845.

[30] Foreign Application Priority Data

Oct. 18, 1995 [JP] Japan ..... 7-269788

[51] Int. Cl.[6] ..... F04C 18/04

[52] U.S. Cl. ..... 418/55.3; 29/888.022; 464/102

[58] Field of Search ..... 418/55.3, 178; 464/102; 29/888.022

[56] References Cited

U.S. PATENT DOCUMENTS 5,263,834 11/1993 Sato et al. ..... 418/178

5,356,277 10/1994 Yamaguchi et al. ..... 418/178

FOREIGN PATENT DOCUMENTS 58-174101 10/1983 Japan ..... 418/55.3

62-248886 10/1987 Japan ..... 418/55.3

63-201383 8/1988 Japan ..... 418/55.3

*Primary Examiner*—John J. Vrablik

*Attorney, Agent, or Firm*—McDermott, Will & Emery

[57] ABSTRACT

A scroll compressor having an extended life due to the support structure for the orbiting scroll, even when using a chlorine-free substitution refrigerant. The support structure includes an Oldham ring for supporting an orbiting scroll so as to allow the orbiting scroll more orbiting motion without rotating about a fixing scroll. The Oldham ring is formed of a different material from both a fixing member and the orbiting scroll. Hence, if a boundary lubrication state occurs in mutually sliding parts, only sliding between different materials occurs, and mutual adhesion in the portion of the boundary lubrication state is avoided. As a result, the shortening of the life due to the wearing of the support structure of the orbiting scroll is prevented.

2 Claims, 4 Drawing Sheets

SCROLL COMPRESSOR AND METHOD FOR MANUFACTURING AN OLDHAM RING THEREFOR

This is a divisional of application Ser. No. 08/730,397, filed Oct. 15, 1996 now U.S. Pat. No. 5,842,845.

BACKGROUND OF THE INVENTION

1. Technical Field of the Invention

The present invention relates to a scroll compressor mainly used in professional or commercial and household freezing and air-conditioning systems.

2. Prior Art

In a motor-driven compressor for freezing and air-conditioning, the compression unit is either a reciprocating type or a rotary type of unit. Both types of units are used in the field of freezing and air-conditioning in household and professional or commercial system. At the present time, both types of compressors are growing in use due to their affordable cost and excellent performance. In particular, a scroll type compressor unit is being employed because such a unit is highly efficient, has low noise, and has low vibration.

The scroll compression mechanism used in the scroll compressor, as is well known, includes a fixed scroll and an orbiting scroll, each having vortex blades that are engaged with each other, with several compression chambers formed between them. Each compression chamber compresses a refrigerant by decreasing in volume as the refrigerant the moves from an outer circumferential side in fluid communication with a suction port to an inner circumference side in communication with a discharge port, by an orbiting motion of the orbiting scroll. The compressed refrigerant is discharged from the discharge port.

In order for the orbiting scroll to move in a proper manner to compress the refrigerant, the orbiting scroll is supported by an Oldham ring, which is used to provide an orbiting motion for the orbiting scroll without rotating the orbiting scroll. The Oldham ring is supported by a fixing member that allows the Oldham ring to move.

The Oldham ring slides between the fixing member and orbiting scroll. The orbiting scroll, fixed scroll, fixing member, and Oldham ring are all made of ferriferous materials.

As the refrigerant, specific CFC (chloro-fluoro-carbon) R12 or designate HCFC (Hydro-chloro-fluoro-carbon) R22 has been used. As compared with the refrigerants used in the past, such as sulfur dioxide and methyl chloride, specific CFC is stable chemically, free from toxicity, and has been widely used as an ideal refrigerant for a long period.

Lately, it is disclosed that chlorine atoms, contained in the molecule of specific CFC, destroy the ozone layer. As a result, substitute refrigerants are being developed and used. As practical substitute refrigerants, chlorine-free HFC (Hydro-fluoro-carbon) and similar refrigerants have been proposed (Hydraulic and Pneumatic Technology, June 1994, published by Nippon Kogyo Shuppan).

However, a compressor using such a substitute refrigerant is not expected to have as excellent lubricity as when using the conventional specific CFC. In particular, the substitute refrigerant does not contain chlorine, which acts as a lubricant. Accordingly, the sliding condition is severe, and in the support structure using an Oldham ring for the orbiting scroll as in the prior art, the sliding parts are likely to wear out, shortening the life of the support structure. This is because the substitute refrigerant cannot be expected to lubricate the Oldham ring of the support structure and the sliding parts of the orbiting scroll and fixing member. The oil film is partly cut and a boundary lubrication state tends to occur. As a result, in this boundary lubrication state portion, which forms with the materials being ferriferous, leads to adhesion of the support structure and a shortened life for this structure.

The shortening of the life of the support structure is a particularly serious problem and is fatal in practical use, especially in a maintenance-free compressor operated for a long period. In an enclosed type of compressor, the life of the support structure itself is supposed to equal the life of the entire compressor.

Hence, it is a primary object of the present invention to solve the above problems, and disclose a scroll compressor free from the problems of having a shortened life due to the wearing of the support structure when using chlorine-free substitute refrigerant.

SUMMARY OF THE INVENTION

The scroll compressor of the present invention comprises a motor, an orbiting scroll, a fixed scroll, a compression mechanism installed in an enclosed container, and a refrigerant supplied to the enclosed container from a refrigeration cycle mechanism installed outside of the enclosed container. The refrigerant circulates in the refrigeration cycle mechanism and the enclosed container. The refrigerant is at least one of HFC (hydro-fluoro-carbon). The compression mechanism has a scroll compression mechanism for compressing the refrigerant between an orbiting scroll driven by the motor and a fixed scroll. The compression mechanism comprises an Oldham ring and a fixing member. The Oldham ring acts to support the orbiting scroll and allows the orbiting scroll to make an orbiting motion without rotating about the fixed scroll. The fixing member acts to support and to move or guide the Oldham ring. The Oldham ring slides on both the fixing member and the orbiting scroll. Preferably, the surface of the Oldham ring is formed of a material different from both materials of the fixing member and the orbiting scroll.

The method of manufacturing a scroll compressor according to the invention includes a step of reforming the surface of an Oldham ring, to form the surface of the Oldham ring of a different material from the materials of the fixing member and orbiting scroll.

According to the present invention, when the scroll compression mechanism is put in action by the start of a motor, suction and compression of the refrigerant are repeated to execute a refrigeration cycle. The refrigerant does not contain chlorine and hence, does not destroy the environment. Lubricity is not expected because the refrigerant does not contain chlorine, and a boundary lubrication state will occur between an Oldham ring and both sliding surfaces of the orbiting scroll and fixing member. However, according to the present invention, the Oldham ring slides against a different material of the orbiting scroll, and also slides against a different material of the fixing member. As pointed out in greater detail below, adhesion between the Oldham ring and the orbiting scroll or fixing member is avoided in the portion of the mutual boundary lubrication state. As a result, the life of the support structure of the orbiting scroll by using an Oldham ring having at least a surface of a different material than the other members of the support structure, the life of the members is extended, and a shortening of the life of the support structure can be avoided, even if a chlorine-free substitute refrigerant is used.

Preferably, the Oldham ring has a steam treated layer formed by steam treatment on its surface.

As a variation, the Oldham ring has a steam treated layer on the surface formed by steam treatment, and also a nitrided layer formed on the steam treated layer.

As another variation, the Oldham ring has a steam treated layer on the surface formed by steam treatment, and also, a reformed layer reformed by manganese phosphate formed on the steam treated layer.

As another variation, the Oldham ring has a hardened surface treated by hardening.

As another variation, the Oldham ring has a ceramic layer coating the surface.

As another variation, the Oldham ring has a physical deposition layer of an inorganic material on its surface.

As another variation, the Oldham ring is composed of a nonporous material, and also has a nitrided layer on its surface.

As another variation, the Oldham ring is composed of a nonporous material, and also has a reformed layer reformed by manganese phosphate on its surface.

In each variation mentioned above, the surface material of the Oldham ring is different from the surface materials of the fixing member and orbiting scroll.

By reforming the surface of the Oldham ring, the surface of the Oldham ring is a different material from the surface materials of the fixing member and orbiting scroll.

Therefore, when the Oldham ring is formed of same material as the orbiting scroll and fixing member, the surface of the Oldham ring may be reformed very easily into a different material from the surface materials of the fixing member and orbiting scroll.

Moreover, if the Oldham ring is a different material from the orbiting scroll and fixing member, the surface of the Oldham ring can be reformed very easily into a different desired material from the surface materials of the fixing member and orbiting scroll.

The invention itself, together with further advantages, will best be understood with reference to the following detailed description taken in conjunction with the accompanying drawings.

DESCRIPTION OF THE PREFERRED EMBODIMENTS

The embodiments of the present invention are described below with reference to FIGS. 1 through 10.

Embodiment 1

Figure 1:
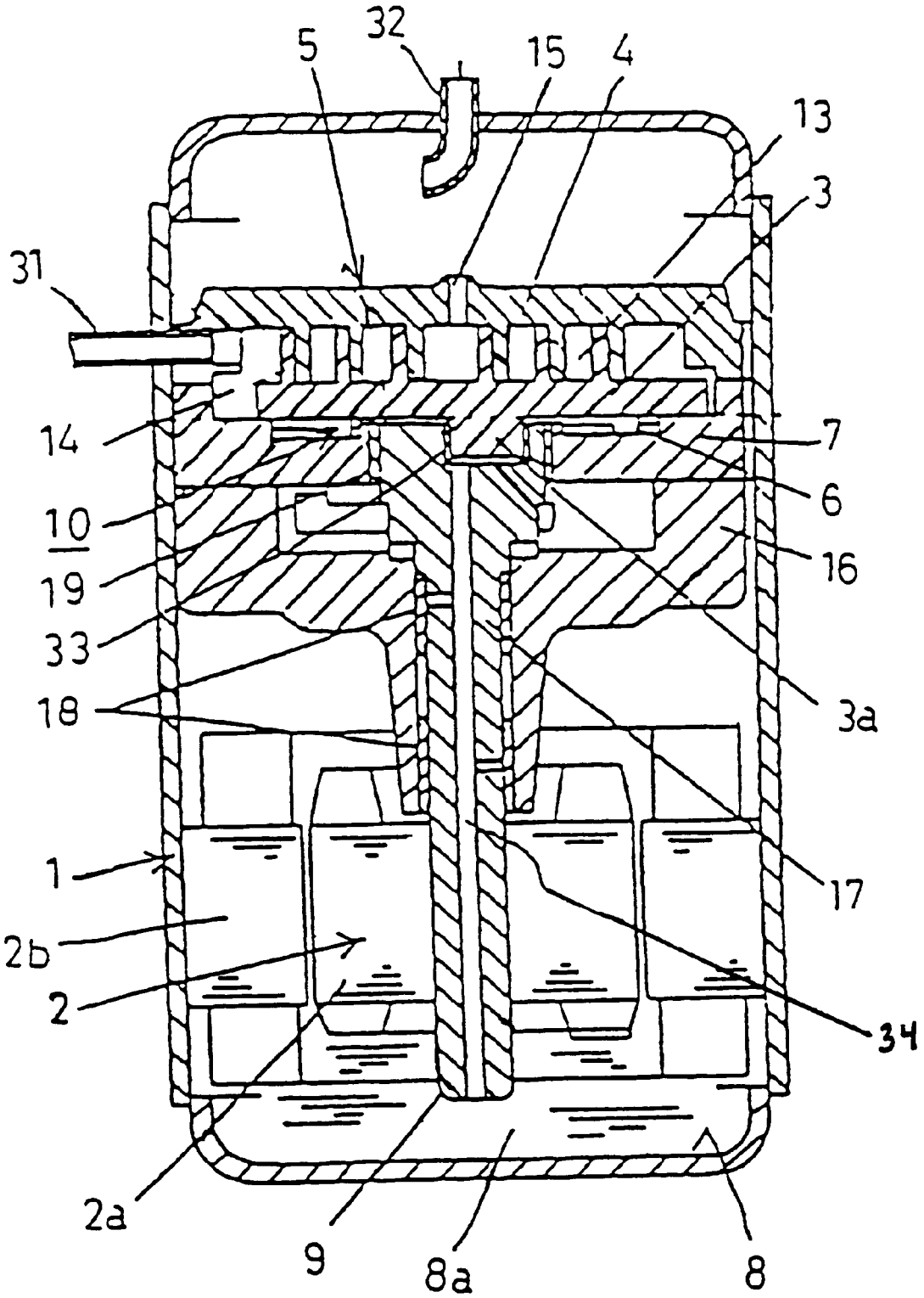
FIG. 1 is a longitudinal sectional view of a scroll compressor.
Figure 2:
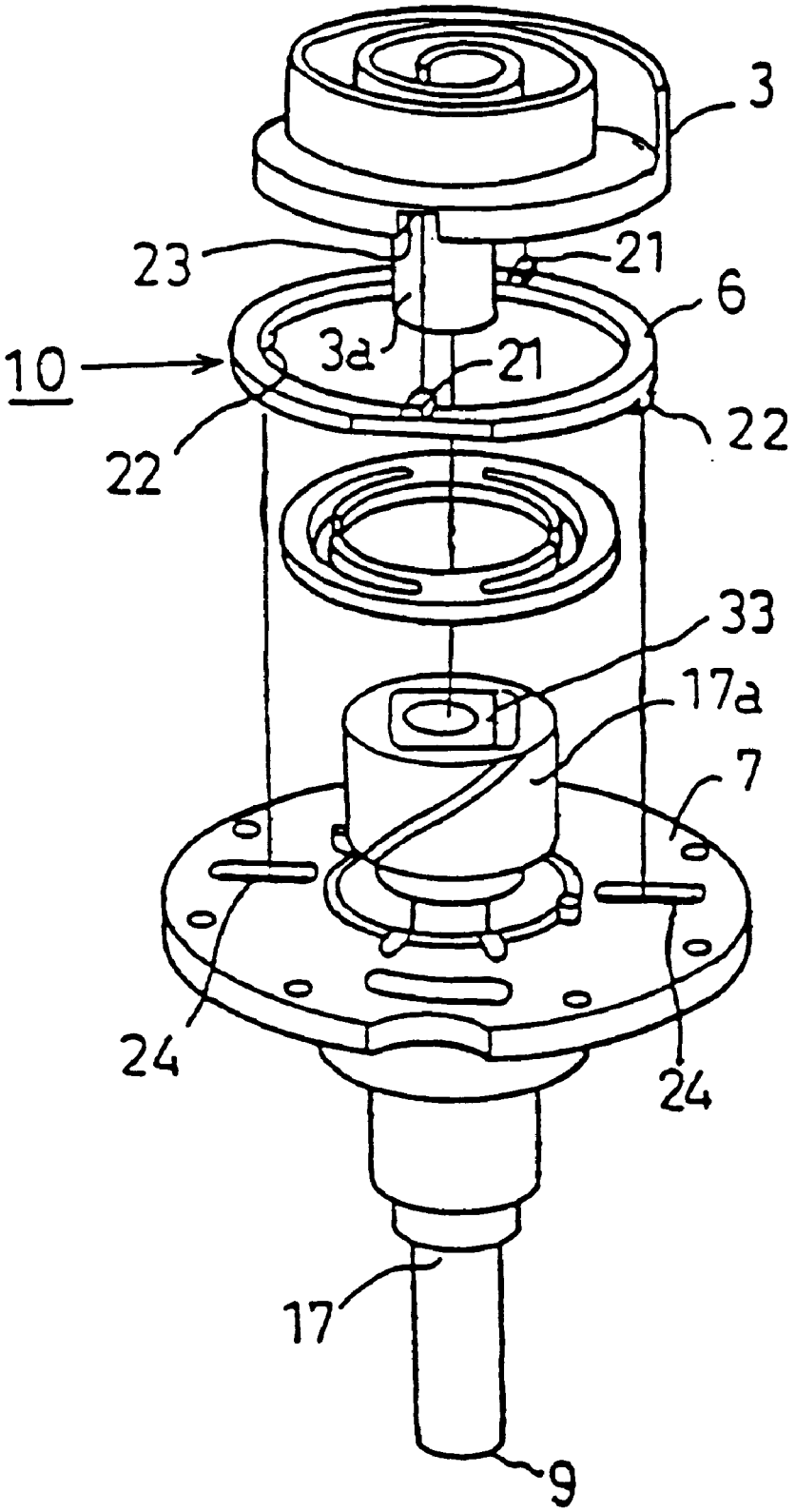
FIG. 2 is a perspective exploded view of essential parts of the compressor in FIG. 1.
Figure 3:
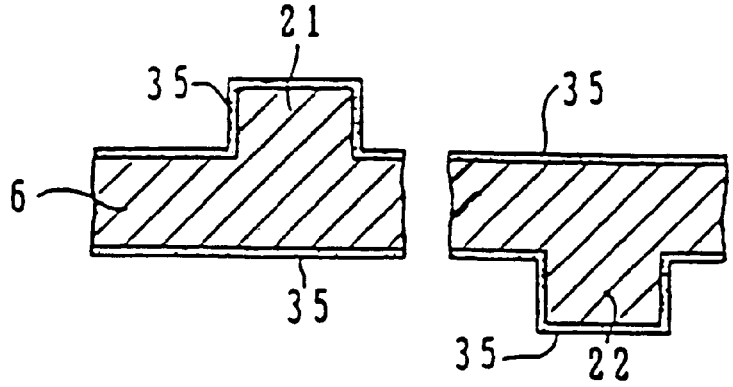
FIG. 3 is a sectional view of essential parts showing a reformed state of an Oldham ring depicted in FIG. 2 according to a first embodiment of the invention.

A first embodiment of the scroll compressor of the invention is shown in FIGS. 1 through 3. This embodiment relates to a scroll compressor of a vertical installation type for refrigeration and air-conditioning systems. FIG. 1 is a longitudinal sectional view of the scroll compressor. FIG. 2 is a perspective exploded view of essential parts of the compressor shown in FIG. 1. FIG. 3 is a sectional view of essential parts of an Oldham ring depicted in FIG. 2.

As shown in FIG. 1, the inside of an enclosed container 1 compresses a mixed refrigerant having at least one type or two or more types of hydrofluorocarbon refrigerants. The container 1 includes a motor 2, and a scroll compression mechanism 5 for compressing the mixed refrigerant between an orbiting scroll 3 driven by the motor 2 and a fixed scroll 4. An Oldham ring 6 is disposed so as to support the orbiting scroll 3 and to allow the orbiting scroll 3 to make an orbiting motion without rotating the orbiting scroll 3. A fixing member 7 and the orbiting scroll 3 are disposed so as to permit the Oldham ring 6 to be movable in an orbiting motion. The surface material of the Oldham ring 6 is formed of a material different from the material of the fixing member 7 and the material of the orbiting scroll 3.

As pointed out above, this embodiment is designed for vertical installation. Accordingly, the scroll compression mechanism 5 is installed in the upper part of the enclosed container 1, and the motor 2 for driving the compression mechanism 5 is installed beneath the scroll compression mechanism 5. The lower part of the container 1 contains a sump 8, oil 8*a* as a lubricant, and an oil guide 9 for sending out the oil 8*a* from the oil sump 8 into the lubricating points through an oil feed path 34. As a variation, the oil guide 9 may be replaced by a pump of another type.

The scroll compression mechanism 5 comprises a fixed scroll 4 at the upper side of the container 1 and an orbiting scroll 3 at the lower side thereof. The orbiting scroll 3 is opposite to the motor 2, and is driven to make an orbiting motion by way of the Oldham ring 6. As a result of this orbiting motion, plural compression chambers 13 are formed between the orbiting scroll 3 and fixed scroll 4, which chambers are reduced in volume, while a refrigerant is compressed from the outer circumferential side communicating with a suction port 14 to the inner circumferential side communicating with a discharge port 15.

The refrigerant is sucked from a suction pipe 31 extending outside of the enclosed container 1 into the suction port 14. The compressed refrigerant is discharged from the discharge port 15 from the enclosed container 1, and is supplied into a refrigeration cycle mechanism for air-conditioning (not shown) from a discharge pipe 32 extending outside of the enclosed container 1. The refrigerant is returned and circulated into the suction pipe 31, thereby executing a refrigeration cycle.

The fixed scroll 4 forms an end plate within the shell of the enclosed container 1. The fixing member 7 forms an upper bearing block fixed in the enclosed container 1 for holding the orbiting scroll 3 in a mutually engaged state with the fixed scroll 4, and also forms another end plate within the container 1. The fixing member 7 is coupled integrally with the orbiting scroll 3 and with a rotor 2*a* of the motor 2, by a lower bearing block 16 fixed in the enclosed container 1 beneath the upper bearing block. The bearing block 16 holds a crankshaft 17 for driving the crankshaft by means of a bearing 18 and a bearing 19. A stator 2*b* is formed around the rotor 2*a*, thereby forming the motor 2.

The Oldham ring 6, as shown in FIG. 3, includes protrusions 21 formed at two positions on a straight line on the ring confronting the side surface of the orbiting scroll 3, and further protrusions 22 formed at two positions on a straight line on the other ring side confronting side surface of the fixing member 7. These protrusions 21, 22 are formed so as to be arranged in mutually right angle directions. These protrusions 21, 22 may be formed integrally with the Oldham ring 6. As a variation, the protrusions may be also joined separately, so that they may be replaced if damaged.

The protrusions 21 of the Oldham ring 6 are fitted into radial grooves 23 provided at two positions on a straight line of the orbiting scroll 3, so that the protrusions 21 may move in parallel directions. The protrusions 22 are fitted into radial grooves 24 at two positions on a straight line of the fixing member 7, so that the Oldham ring 6 may move in the parallel direction of the protrusions 22. Hence, the orbiting scroll 3 is supported and guided to make the orbiting scroll move in an orbiting motion without rotating. The orbiting scroll 3 is fitted into a slider 33 by a protruding axis 3*a* at an eccentric position, which permits the scroll 3 to slide on a main axis 17*a* of the crankshaft 17 in the radial direction. As a result, when the crankshaft 17 rotates, the orbiting scroll 3 makes an orbiting motion without rotating through the slider 33 and Oldham ring 6.

The above specific relationship of the members, arrangement of means, support, drive, slide mechanism of fluid by sucking, compressing and discharging, etc. may be composed freely as far as the requirements of the claims of the invention are satisfied.

The refrigerant used in the refrigeration cycle is a mixed refrigerant containing one or two or more types of hydro-fluoro-carbon refrigerants, and does not contain chlorine and hence, does not destroy the environment. Practical examples of such refrigerants include HFC (hydro-fluoro-carbon) and FC (fluoro-carbon) having a boiling point close to that of HCFC22, and for example, R-134a, R-410A, and R-407C are usable.

The refrigerant discharged into the enclosed container 1 can permeate into the inner narrow parts of the machine sliding parts, but lubricity is not expected because chlorine is not contained in the refrigerant. Hence, a boundary lubrication state may occur in the sliding parts of the Oldham ring 6, the orbiting scroll 3, and the fixing member 7. However, since according to the present invention, the Oldham ring 6 is made of a material different from the orbiting scroll 3 and fixing member 7, the mutually different materials permit the elements to slide on each other without significant wear. Accordingly, the present invention has the advantage of avoiding adhesion within the support structure in the portion of a boundary lubrication state. As a result, the life of the support structure 10 using an Oldham ring 6 with an orbiting scroll 3 is extended. Therefore, the problem of shortening the life of the support structure 10 is eliminated, even if a substitute refrigerant not containing chlorine is used.

In the first embodiment, as shown in FIG. 3, a steam treated layer 35 is formed by steam treating the surface of the Oldham ring 6. In particular, the surface of the Oldham ring 6 is reformed by steam treatment into a material different from the materials of the orbiting scroll 3 and fixing member 7. The Oldham ring 6 can be easily modified by a simple surface reforming treatment. Hence, if the Oldham ring 6 is composed of the same material as the orbiting scroll 3 and fixed member 7, or if the orbiting scroll 3 and fixing member 7 are composed of different materials, the surface materials of the Oldham ring 6 can be easily reformed. The existing parts of a scroll compressor can be reformed according to the present invention to extend the life of the support structure when using a refrigerant that does not include chlorine.

In this embodiment, the Oldham ring 6 is composed of a ferriferous material, the orbiting scroll 3 of aluminum metal, and the fixing member 7 of ferriferous material.

The preferred steam treatment of the Oldham ring 6 is a treatment of the surface of the ring by steam at a temperature within a range of about 500 to about 600° C. The treating time is preferred to be from about 1 hour to about 100 hours. With such a steam treatment, an oxide film is formed as a steam treated layer 35 on the Oldham ring. The steam treated layer 35 can sufficiently prevent adhesion between the members of the support structure due to defective lubrication in the mechanical sliding parts between the orbiting scroll 3 and fixing member 7. Moreover, the oxide film reformed by steam treatment can enhance the surface strength and extend the life of the support structure.

Embodiment 2

Figure 4:
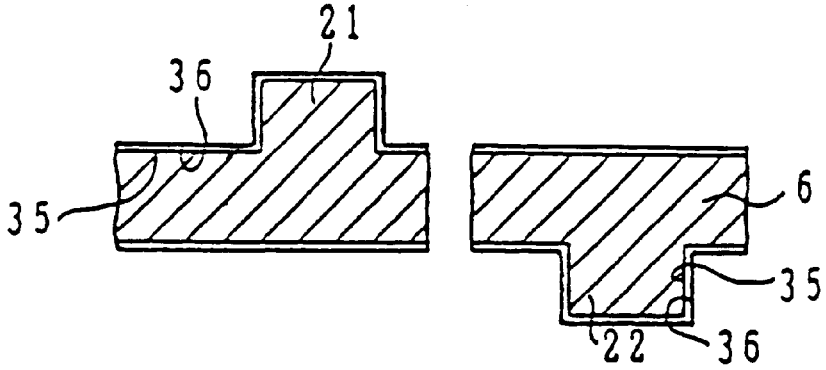
FIG. 4 is a sectional view showing a reformed state of an Oldham ring of a scroll compressor according to a second embodiment of the invention.

A second embodiment of the scroll compressor of the invention is depicted in FIG. 4. The scroll compressor of the embodiment is roughly same in construction as the scroll compressor shown in FIG. 1 and FIG. 2, except that the constitution of the Oldham ring 6 is different. A sectional view of the essential parts of the Oldham ring 6 comprising this embodiment is shown in FIG. 4. As shown in FIG. 4, the steam treated surface layer 35 of the Oldham ring 6 is same as in the first embodiment. However, the layer 35 is further nitrided by a gas nitriding treatment to form a further nitrided layer 36 on the layer 35.

In this construction, the surface of the Oldham ring 6 having the steam layer 35 is further coated with the nitride layer 36, so that a different material surface of a higher wear resistance is formed on the layer 35. Hence, the life of the support structure is further extended. The Oldham ring 6, if made of a ferriferous porous material (for example, a sinter material), can be easily fabricated by molding. Moreover, since the pores are sealed, the change in durability due to porous structure can be improved.

The nitriding treatment is preferred to be done, for example, in an ammonia gas atmosphere, at a temperature of about 500 to about 600° C., for about 1 to about 100 hours. The higher the treating temperature, the higher the hardness of the nitrided layer 36 becomes. Therefore, the hardness can b e adjusted by setting the treating temperature. As a variance, the nitriding treatment can be realize by many other methods than the above-described process.

Embodiment 3

Figure 5:
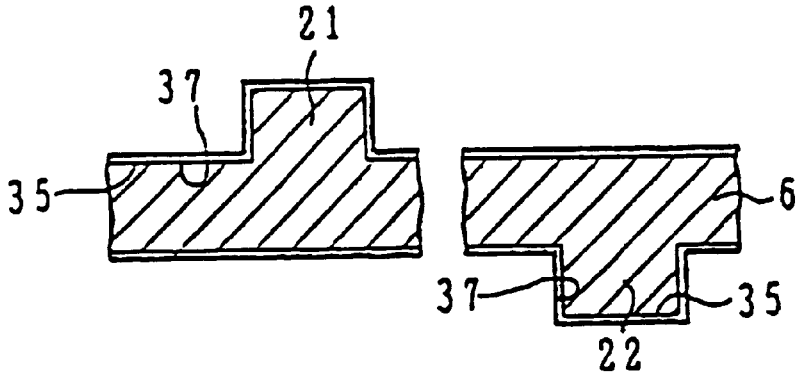
FIG. 5 is a sectional view showing a reformed state of an Oldham ring of a scroll compressor according to a third embodiment of the invention.

A third embodiment of the scroll compressor of the invention is shown in FIG. 5. The scroll compressor of the third embodiment is roughly the same in construction as the scroll compress or shown in FIG. 1 and FIG. 2, except that the construction of the Oldham ring 6 is different. A sectional view of the essential parts of the Oldham ring 6 forming this third embodiment is shown in FIG. 5. As shown in FIG. 5, on the steam treated layer 35, formed on the surface of the Oldham ring 6 in the same manner as in the first embodiment, a reformed layer 37, reformed by manganese phosphate, is further formed.

In th is construction, the surface of the Oldham ring 6, having the steam treated layer 35, is further coated with a reformed layer 37 of manganese phosphate, so that a solid lubricated and smoothed surface is formed. Therefore, a different material surface than the previous embodiments is formed. The reformed layer 37 has a higher slipping performance nad results in a longer life for the support structure. The construction of the third embodiment is particularly effective in the initial phase of use of a scroll compressor.

As a variation, if the Oldham ring 6 is made of a nonporous material, without steam treatment, the surface of the the Oldham ring can be made more wear resistant by a reforming treatment using only manganese phosphate.

Embodiment 4

Figure 6:
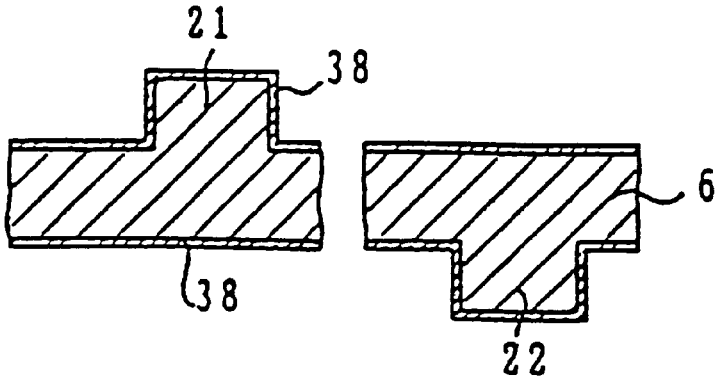
FIG. 6 is a sectional view showing a reformed state of an Oldham ring of a scroll compressor according to a fourth embodiment of the invention.

FIG. 6 shows a fourth embodiment of an Oldham ring used in the scroll compressor according to the present invention. As shown in FIG. 6, the surface of the Oldham ring 6 is quenched, and a hardened layer 38 is formed. In this construction, the surface of the Oldham ring 6 has a different material from the other elements of the support structure and is enhanced in hardness, as compared with the orbiting scroll and fixing member. As a result, such an Oldham ring exhibits the same wear resistant effects as the first embodiment.

Embodiment 5

Figure 7:
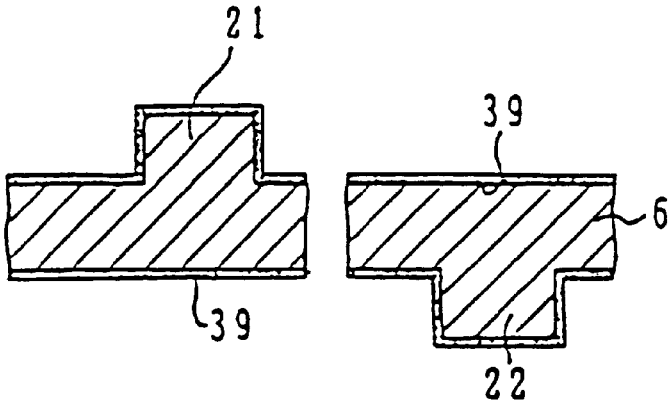
FIG. 7 is a sectional view showing a reformed state of an Oldham ring of a scroll compressor according to a fifth embodiment of the invention.

FIG. 7 shows a fifth embodiment of an Oldham ring used in the scroll compressor of the invention. As shown in FIG. 7, the surface of the Oldham ring 6 has a ceramic layer 39 coated with ceramics. In this construction, the surface of the Oldham ring 6 is enhanced in hardness, as compared with the orbiting scroll and fixing member. The different material surface has a superior slipping performance. As a result, the ring surface exhibits the same wear resistant effects as the ring in the first embodiment.

Further, when a substitute refrigerant such as HFC and FC, and an ester oil compatible with such a substitute refrigerant are used, the oil is hydrolyzed to form fatty acid during use of the scroll compressor. This fatty acid may be chemically bonded with worn sludge due to corrosion of the metal surface to form a metal soap. However, this metal soap is a foreign matter and causes problems.

On the other hand, by forming a ceramic layer 39 on the surface of the Oldham ring according to this embodiment, the occurrence of foreign matter can be prevented.

Practical examples of oil compatible with a substitute refrigerant include fatty acid ester and ester carbonate, among others.

Embodiment 6

Figure 8:
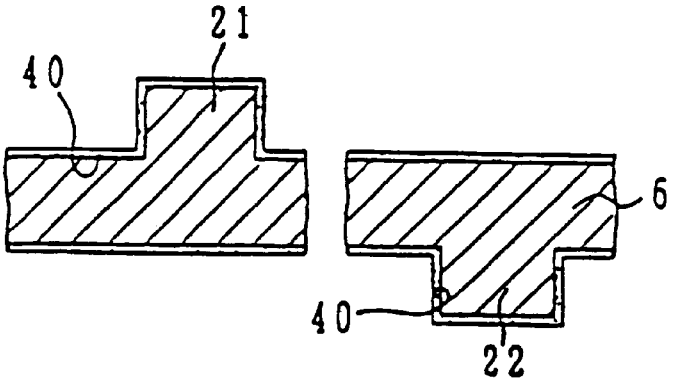
FIG. 8 is a sectional view showing a reformed state of an Oldham ring of a scroll compressor according to a sixth embodiment of the invention.

FIG. 8. shows a sixth embodiment of an Oldham ring used in the scroll compressor of the invention. As shown in FIG. 8, the surface of the Oldham ring 6 has a deposition layer 40 formed by physical vapor deposition (PVD) of ceramics, inorganic oxide or other inorganic material. The method of physical vapor deposition includes vacuum deposition, sputtering, and ion plating, among others.

In this construction, the surface of the Oldham ring 6 becomes is a different material and has an enhanced hardness and an excellent slipping performance, as compared with the orbiting scroll and fixing member. As a result, the same advantages as in the fifth embodiment are exhibited.

This PVD was executed by heating in nitrogen gas around 200° C., by putting a chromium nitride bar at the plus side and the Oldham ring 6 at the minus side.

Embodiment 7

Figure 9:
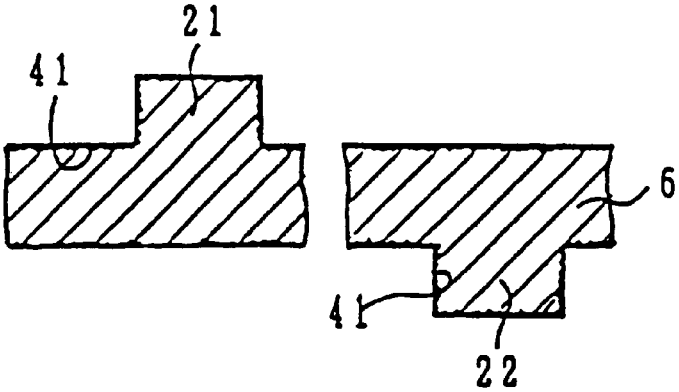
FIG. 9 is a sectional view showing a reformed state of an Oldham ring of a scroll compressor according to a seventh embodiment of the invention.

FIG. 9. shows a seventh embodiment of an Oldham ring used in the scroll compressor of the present invention. As shown in FIG. 9, the surface of the Oldham ring 6 has a nitride layer 41 that is nitrided in the same manner as in the second embodiment.

In this construction, the surface of the Oldham ring 6 has a different material surface enhanced in hardness by the nitride layer 41, as compared with the orbiting scroll and fixing member. As a result, the same advantages as in the first embodiment are exhibited.

Embodiment 8

Figure 10:
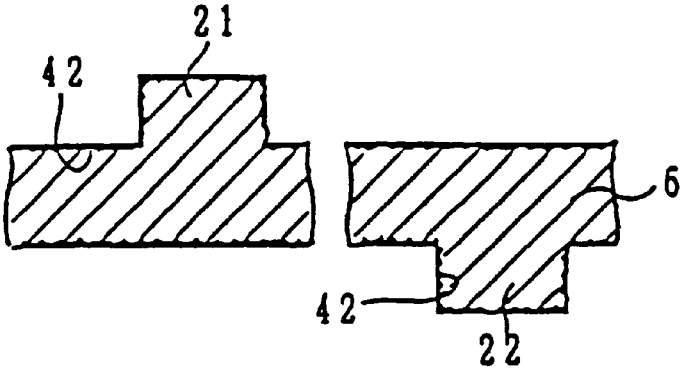
FIG. 10 is a sectional view showing a reformed state of an Oldham ring of a scroll compressor according to an eighth embodiment of the invention.

FIG. 10 shows an eighth embodiment of an Oldham ring used in the scroll compressor of the invention. As shown in FIG. 10, the Oldham ring is formed of a nonporous material and the surface of the Oldham ring 6 has a reformed layer 42 reformed by manganese phosphate.

In this construction, the surface of the Oldham ring 6 has a different material surface smoothed and enhanced in slipping performance by the reformed layer 42, reformed by manganese phosphate, to form a solid lubricating material, as compared with the orbiting scroll and fixing member. As a result, the same advantages as in the first embodiment are exhibited.

According to the present the invention, the problem of wear between sliding parts, when using a chlorine-free refrigerant that lacks lubricity and sets up a boundary lubrication state, is solved by forming the sliding parts of mutually different materials. In this manner, adhesion in the portion of boundary lubrication state is avoided and the life of the Oldham ring and other members of the support structure extended. The embodiments described above provide the significant advantages of extending the life of the Oldham ring, fixing member and orbiting scroll. Hence, a shortening of life due of the support structure in a scroll compressor is prevented, even when using a chlorine-free substitute refrigerant.

Moreover, by forming a reformed layer on the surface of the Oldham ring, if the base material of the Oldham ring is same as the material of the orbiting scroll and fixing member, or if the orbiting scroll and fixing member are mutually made of different materials, the existing parts can be used without a problem. Specifically, according to the present invention, the surface of the Oldham ring is reformed and the life of the scroll compressor extended.

Of course, it should be understood that a wide range of changes and modifications can be made to the preferred embodiment described above. It is therefore intended that the foregoing detailed description be understood that it is the following claims, including all equivalents, which are intended to define the scope of this invention.

What is claimed is:

1. An enclosed scroll compressor, comprising:

a compression mechanism having a fixed scroll, an orbiting scroll, an Oldham ring and fixing member, the surface of said Oldham ring being formed of a material that is different than the material used to form said fixing member and said orbiting scroll; and a motor for driving said orbiting scroll in an orbiting motion for compressing a refrigerant between said fixed scroll and said orbiting scroll;

said refrigerant including at least one of Hydro-Fluoro-carbon and Fluoro-carbon, each one of said Hydro- Fluoro-carbon and said Fluoro-carbon having less lubricity than a refrigerant including Chloro-Fluoro-carbon and Hydro-Chloro-Fluoro-carbon.

said Oldham ring supporting said orbiting scroll to allow said orbiting scroll to make an orbiting motion without rotating about said fixed scroll when said orbiting scroll is driven by said motor.

said Oldham ring sliding on both said fixing member and said orbiting scroll, wherein the surface of said orbiting scroll is made of aluminum, wherein said Oldham ring is made of nonporous material, and wherein said Oldham ring also has a reformed surface layer of manganese phosphate formed on said nonporous material, said reformed surface layer being of a material that is different than the material used to form the surface of said fixing member and said orbiting scroll.

2. A method of manufacturing an Oldham ring for an enclosed scroll compressor that has a compression mechanism comprising a fixed scroll, an orbiting scroll, an Oldham ring and a fixing member, and a motor for driving said orbiting scroll in an orbiting motion for compressing a refrigerant between said fixed scroll and said orbiting scroll, said refrigerant including at least one of Hydro-Fluoro-carbon and Fluoro-carbon and each one of said Hydro-Fluoro-carbon and Fluoro-carbon having less lubricity than a refrigerant including Chloro-Fluoro-carbon and Hydro-Chloro-fluoro-carbon, said Oldham ring resting on said fixing member and supporting said orbiting scroll to allow said orbiting scroll to make an orbiting motion without rotating about said fixed scroll when said orbiting scroll is driven by said motor, said Oldham ring sliding on both said fixing member and said orbiting scroll, said method comprising the steps of:

forming the surface of said orbiting scroll of aluminum;

forming said Oldham ring of a nonporous material; and reforming the surface of said Oldham ring to form a reformed surface layer on the surface of said Oldham ring with a material that is different than the material used to form said fixing member and said orbiting scroll by treating the nonporous material with manganese phosphate to form a solid lubricating film on said nonporous material.

* * * * *